US008590854B1

(12) United States Patent
Salazar

(10) Patent No.: US 8,590,854 B1
(45) Date of Patent: Nov. 26, 2013

(54) READING MATERIAL SUPPORT SYSTEM

(76) Inventor: Alfred J. Salazar, Hanford, CA (US)

( * ) Notice: Subject to any disclaimer, the term of this patent is extended or adjusted under 35 U.S.C. 154(b) by 0 days.

(21) Appl. No.: 13/283,092

(22) Filed: Oct. 27, 2011

(51) Int. Cl.
*A47G 1/24* (2006.01)

(52) U.S. Cl.
USPC ..... 248/457; 248/917; 248/500; 248/121; 248/346.01; 297/153; 108/43

(58) Field of Classification Search
USPC ..... 248/457, 458, 441.1, 121, 130, 131, 248/127, 500, 917, 918, 919, 371, 34, 6.01, 248/346.03, 346.06; 297/170, 153, 148, 297/174; 108/116, 6, 26, 50.01, 43; 281/42–45, 455
See application file for complete search history.

(56) References Cited

U.S. PATENT DOCUMENTS

| | | | | | |
|---|---|---|---|---|---|
| 551,256 | A | * | 12/1895 | Brown | 248/451 |
| 701,010 | A | * | 5/1902 | Behrens | 248/457 |
| 756,631 | A | * | 4/1904 | Herbert | 248/448 |
| 1,035,290 | A | | 8/1912 | Wood | |
| 1,765,514 | A | * | 6/1930 | Wetmore et al. | 108/10 |
| 1,790,808 | A | * | 2/1931 | Griffith | 297/153 |
| 1,947,053 | A | * | 2/1934 | Mason | 248/453 |
| 2,034,835 | A | | 3/1936 | Rubino | |
| 2,691,239 | A | * | 10/1954 | McCollum | 248/444 |
| 2,743,550 | A | * | 5/1956 | Felice | 248/457 |
| 3,475,052 | A | * | 10/1969 | Kaposi | 297/153 |
| 3,606,450 | A | * | 9/1971 | Sedgwick | 297/149 |
| 3,698,328 | A | | 10/1972 | Weir | |
| 4,054,315 | A | * | 10/1977 | Czarnowski | 297/153 |
| 4,108,083 | A | * | 8/1978 | Espinosa | 108/6 |
| 4,163,539 | A | * | 8/1979 | Awofolu | 248/452 |
| 4,632,451 | A | * | 12/1986 | Lee | 297/153 |
| 5,054,736 | A | * | 10/1991 | Champoux | 248/444 |
| 5,460,102 | A | * | 10/1995 | Pasmanick | 108/43 |
| 5,690,310 | A | * | 11/1997 | Brown | 248/448 |
| 5,761,753 | A | * | 6/1998 | Talbert | 4/559 |
| 5,816,649 | A | | 10/1998 | Shields | |
| 5,839,713 | A | * | 11/1998 | Wright | 248/346.01 |
| 5,884,889 | A | | 3/1999 | Crosby | |
| 5,918,907 | A | * | 7/1999 | Ho | 281/45 |
| D418,327 | S | | 1/2000 | Sullins | |
| 6,017,085 | A | | 1/2000 | LaCroix | |
| 6,491,275 | B1 | * | 12/2002 | Goodman et al. | 248/346.01 |
| 6,739,653 | B1 | * | 5/2004 | Hoekstra | 297/148 |
| 6,773,060 | B2 | * | 8/2004 | Sher | 297/188.14 |
| 7,073,449 | B2 | * | 7/2006 | Pipkin | 108/44 |
| 7,293,751 | B2 | * | 11/2007 | Eriksson | 248/346.01 |
| 7,367,618 | B2 | * | 5/2008 | Rossini | 297/188.18 |
| 7,520,484 | B1 | * | 4/2009 | Kamath et al. | 248/447 |
| 8,011,627 | B2 | * | 9/2011 | Andkjar | 248/214 |
| 8,322,290 | B1 | * | 12/2012 | Mignano | 108/9 |
| 8,347,791 | B1 | * | 1/2013 | Gray | 108/42 |
| 2008/0073946 | A1 | | 3/2008 | Maione | |

* cited by examiner

*Primary Examiner* — Terrell McKinnon
*Assistant Examiner* — Monica Millner

(57) ABSTRACT

A reading material support system having a base panel, a book support panel having a lip on at least a portion of a bottom edge of the book support panel, the book support panel is pivotally attached to a top surface of the base panel via a pivot mounting means, the pivot mounting means having a first half pivot mount on the top surface of the base panel and a second half pivot mount on a back surface of the book support panel, the second half pivot mount pivotally engages the first half pivot mount such that the book support panel can pivot about an axis parallel to the base panel, and a securing means for securing the book support panel in a position relative to the base panel.

1 Claim, 3 Drawing Sheets

READING MATERIAL SUPPORT SYSTEM

FIELD OF THE INVENTION

The present invention is directed to a system for holding a piece of reading material while a user sits in an easy chair.

BACKGROUND OF THE INVENTION

Some individuals have difficulty holding a book or an electronic reading device while sitting in an easy chair, for example due to back problems, shoulder problems, wrist problems, neck problems, arm problems. The present invention features a reading material support system. The system of the present invention supports a piece of reading material (e.g., book, electronic reading device, etc.) for a user while he/she sits in an easy chair. The system of the present invention can help provide comfort to a user.

SUMMARY

The present invention features a reading material support system. In some embodiments, the reading material support system comprises a base panel, a first half pivot mount is rotatably mounted on a top surface of the base panel via a dowel that extends from the first half pivot mount into a hole disposed in the base panel, the first half pivot mount can rotate in a first direction and a second direction about the hole; a book support panel having a lip disposed on at least a portion of a bottom edge, a second half pivot mount is disposed on a back surface of the book support panel wherein the second half pivot mount pivotally engages the first half pivot mount such that the book support panel can pivot about an axis parallel to the base panel; and a securing means for securing the book support panel in a position relative to the base panel.

In some embodiments, the first half pivot mount is positioned about halfway between a first end and a second end of the base panel. In some embodiments, an axle parallel to the base panel connects the second half pivot mount and the first half pivot mount, the book support panel can pivot about the axle, in some embodiments, the securing means comprises a wing nut that engages the axle, the wing nut can be rotated in a first direction and a second direction respectively tightening and loosening engagement between the pivot mounts. In some embodiments, the system further comprises an aperture disposed in the base panel.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
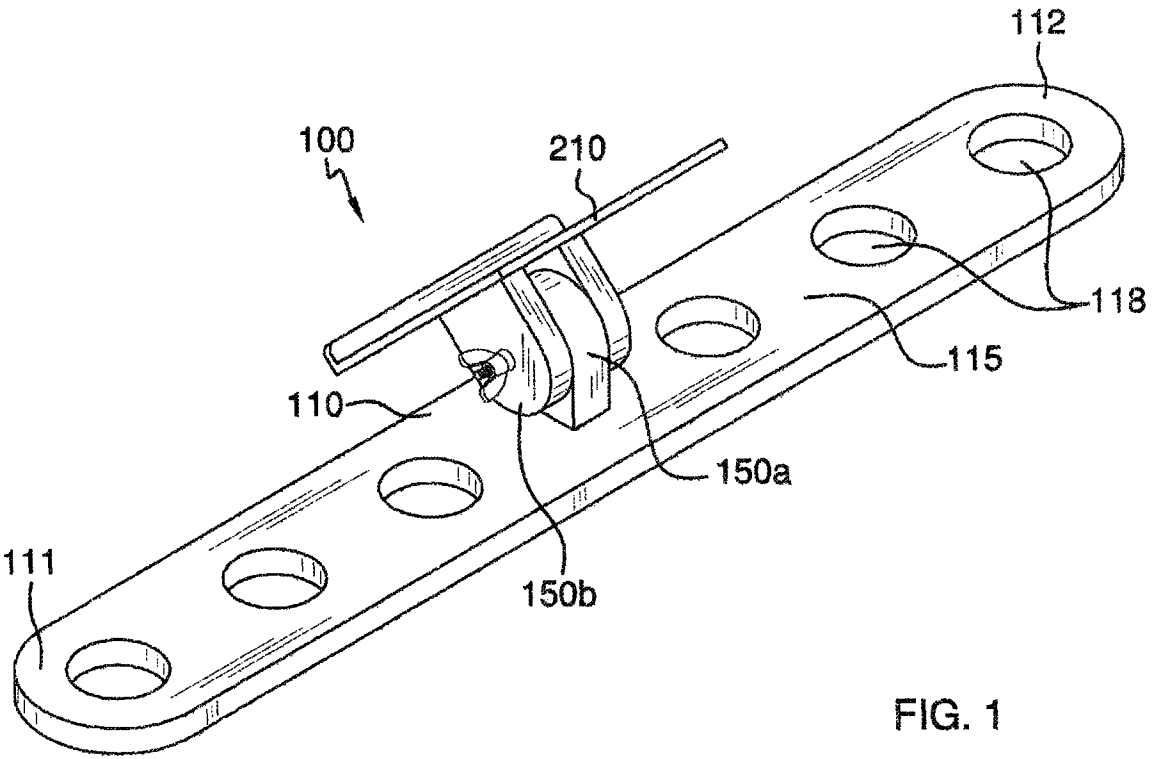
FIG. 1 is a perspective view of the system of the present invention.
Figure 2:
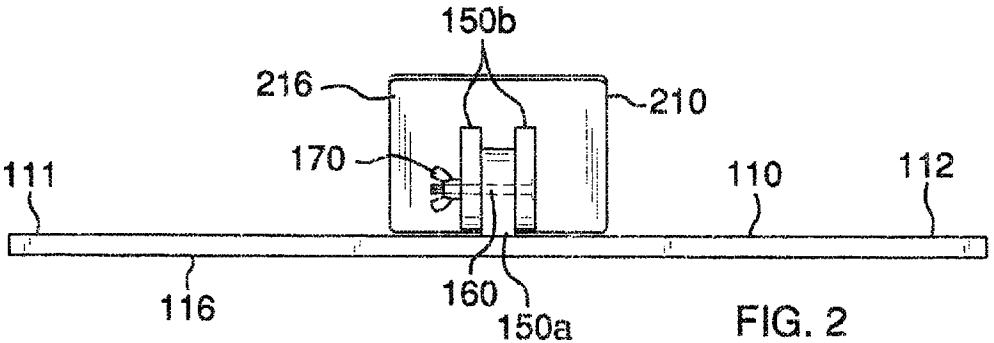
FIG. 2 is a back view of the system of the present invention.

Referring now to FIG. 1-4, the present invention features a reading material support system 100. In some embodiments, the system comprises a chair 300 having a first arm 310 and a second arm 320. In some embodiments, the chair is an easy chair or a recliner. The system 100 comprises a base panel 110 (e.g., an elongated base panel) having a first end 111, a second end 112, a top surface 115, and a bottom surface 116. In some embodiments, one or more apertures 118 are disposed in the base panel 110 along its length. In some embodiments, a bottom surface 116 of the base panel 110 is centrally located on the first arm 310 and the second arm 320 of the chair. In some embodiments, the first end 111 of the base panel 110 sets on the first arm 310 and the second end 112 of the base panel 110 sets on the second arm 320.

The system 100 further comprises a book support panel 210 pivotally attached to the base panel 110. The book support panel 210 is adapted to support a piece of reading material 101 including but not limited to a book, magazine, or an electronic reading device. The book support panel 210 has a front surface 215, a back surface 216, and a bottom edge 212. A lip 220 is disposed along all or a portion of the bottom edge 212. The lip 220 helps keep the piece of reading material 101 propped against the book support panel 210 and help prevent the piece of reading material 101 from slipping.

A first half pivot mount 150*a* is disposed on the top surface 115 of the base panel 110. In some embodiments, the first half pivot mount 150*a* is positioned about halfway between the first end 111 and the second end 112. A second half pivot mount 150*b* is disposed on the back surface 216 of the book support panel 210. The second half pivot mount 150*b* pivotally engages the first half pivot mount 150*a* such that the book support panel 210 can pivot about an axis parallel to the base panel 110 (e.g., see FIG. 3). For example, in some embodiments, an axle 160 connects the second half pivot mount 150*b* and the first half pivot mount 150*a*, and the book support panel 210 can pivot about the axle 160. The axle 160 is parallel to the base panel 110. In some embodiments, the first half pivot mount 150*a* is sandwiched between the second half pivot mount 150*b* (e.g., the second half pivot mount 150*b* comprises two wings that sandwich the first half pivot mount as shown in FIG. 1). The pivot mounts 150 are not limited to the aforementioned configuration. In some embodiments, the axle 160 is a threaded rod.

The book support panel 210 can be secured in a position relative to the base panel 110 via a securing means. In some embodiments, the securing means comprises a wing nut 170 that engages the axle 160 between the first half pivot mount 150*a* and the second half pivot mount 150*b*. The wing nut 170 can be rotated in a first direction and a second direction respectively tightening and loosening the engagement between the pivot mounts 150.

Figure 3:
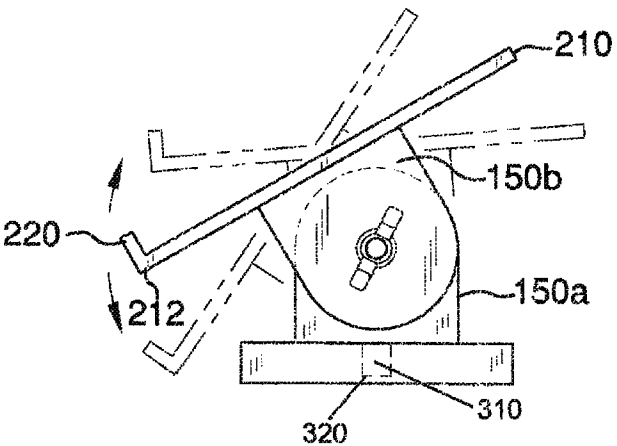
FIG. 3 is a side view of the system of the present invention.
Figure 4:
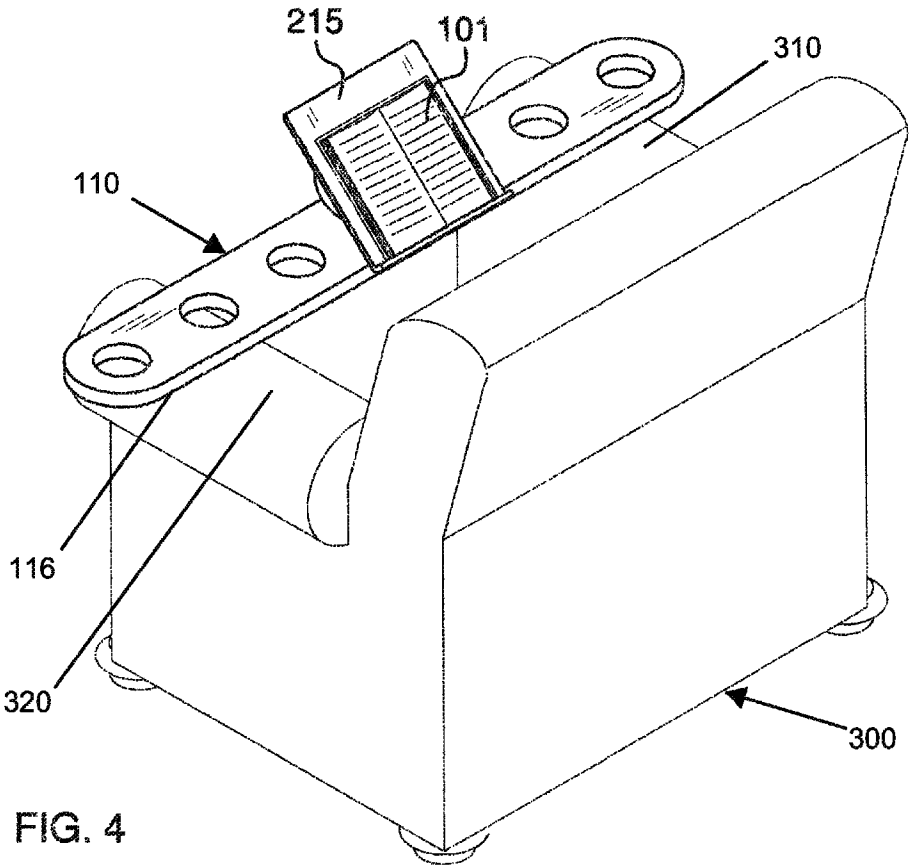
FIG. 4 is an in-use view of the system of the present invention.

As shown in FIG. 3, the first half pivot mount 150*a* is rotatably mounted on the top surface 115 of the base panel 110. For example, a dowel 310 extends downwardly from the first half pivot mount 150*a* into a hole 320 disposed in the base panel 110. The first half pivot mount 150*a* can rotate in a first direction (e.g., clockwise) and a second direction (e.g., counterclockwise) about the hole 320.

The system 100 of the present invention may be constructed in a variety of sizes. For example, in some embodiments, the base panel 110 is between about 20 to 30 inches in length as measured from the first end 111 to the second end 112. In some embodiments, the base panel 110 is between about 30 to 40 inches in length as measured from the first end 111 to the second end 112 in some embodiments, the base panel 110 is more than about 40 inches in length.

As used herein, the term "about" refers to plus or minus 10% of the referenced number. For example, an embodiment wherein the base panel 110 is about 30 inches in length includes a base panel 110 that is between 27 and 33 inches in length.

The disclosures of the following U.S. patents are incorporated in their entirety by reference herein: U.S. Pat. No. 1,035,290; U.S. Pat. No. 2,034,835; U.S. Pat. No. 2,691,239; U.S. Pat. No. 3,698,328; U.S. Pat. No. 5,816,649; U.S. Pat. No. 5,884,889; U.S. Design Pat. No. D418327; U.S. Pat. No. 6,017,085, U.S. Patent Application No. 2008/0073946.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary and are not intended in any way to limit the scope of the claims to the particular features having the corresponding reference numbers in the drawings.

What is claimed is:

1. A support system 100 for supporting a piece of reading material, said support system 100 consisting of:

(a) a base panel 110, a first half pivot mount 150*a* is rotatably mounted on a top surface 115 of the base panel 110 via a dowel 310 that extends from the first half pivot mount 150*a* removably into a hole 320 disposed in the base panel 110, the first half pivot mount 150*a* can rotate in a first direction and a second direction about the hole 320;

(b) a book support panel 210 having a lip 220 disposed on at least a portion of a bottom edge 212, a second half pivot mount 150*b* is disposed on a back surface 216 of the book support panel 210 wherein the second half pivot mount 150*b* pivotally engages the first half pivot mount 150*a* such that the book support panel 210 can pivot about an axis parallel to the base panel 110; and (c) a securing means for securing the book support panel 210 in a position relative to the base panel 110; and (d) a chair 300 having a first arm 310 and a second arm 320; wherein a bottom surface 116 of the base panel 110 is disposed on the first arm 310 and the second arm 320 of the chair.

* * * * *